US006279851B1

(12) United States Patent
Huss et al.

(10) Patent No.: US 6,279,851 B1
(45) Date of Patent: Aug. 28, 2001

(54) TOPOGRAPHY-AIDED GUIDANCE SYSTEM AND PROCESS

(75) Inventors: Ronald E. Huss, Los Angeles; Robert E. Vitali, Huntington Beach, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 07/440,969

(22) Filed: Nov. 22, 1989

(51) Int. Cl.[7] ..... F42B 15/01

(52) U.S. Cl. ..... 244/3.15; 244/3.1; 244/3.16; 244/3.17; 244/3.19; 342/62; 342/63; 342/195

(58) Field of Search ..... 364/424.01, 434, 364/436, 444, 447, 462, 423, 424.02; 342/455, 25, 26, 27, 33, 36, 41, 61–65, 70, 175, 189, 195; 244/3.15, 3.14, 3.16–3.19; 356/152–4; 701/301

(56) References Cited

U.S. PATENT DOCUMENTS 3,781,530 * 12/1973 Britland et al. ..... 701/301
3,964,695 * 6/1976 Harris ..... 342/455
4,123,168 * 10/1978 Howell ..... 356/152
4,456,862 * 6/1984 Yueh ..... 244/3.14
4,502,650 * 3/1985 Yueh ..... 244/3.15
4,739,329 * 4/1988 Ward ..... 364/423

* cited by examiner

*Primary Examiner*—Bernarr E. Gregory
(74) *Attorney, Agent, or Firm*—Leonard A. Alkov; Glenn H. Lenzen, Jr.

(57) ABSTRACT

In missile guidance systems, knowledge of the target's flight policy and doctrine, along with an analysis of local topographic features, are used in a minimum commitment guidance policy. By assuming certain objectives of the target, paths may be defined by evaluating the degree of detection avoidance provided by the terrain adjacent to the various paths. To maximize the probability of intercept, a missile may be guided in a direction covering the most likely of these paths for periods while the target is hidden. The paths are then reevaluated each time the target is detected. For highly maneuverable targets that are capable of executing violent changes in direction and speed, the topography-aided guidance system maximizes the probability that the target can escape the missile intercept envelope. The present invention relates to a topographay-aided missile guidance system that minimzes the probability that an airborne target can escape the missile's intercept envelope, where the minimization is over substantially all of the potential actions that the target may take.

6 Claims, 1 Drawing Sheet

RANGE EXCESS : DIFFERENCE BETWEEN MAXIMUM RANGE REMAINING AND RANGE TO INTERCEPT $E_i$ IS THE RANGE EXCESS AT SPEED $V_i$

WEIGHTED RANGE EXCESS $= \sum_i E_i \times P(V_i)$

TOPOGRAPHY-AIDED GUIDANCE SYSTEM AND PROCESS

BACKGROUND OF THE INVENTION

1. Field of the Invention

The invention relates to a topography-aided missile guidance system and to a process for incorporating topographical information into missile guidance systems.

2. Description of Related Art

Until now, conventional missile guidance systems used an intercept logic based upon a projected trajectory of the target, commonly implemented with Kalman filters. However, for targets that drop out of sight for extended periods, or for targets that can execute violent maneuvers accompanied by large changes in speed, the prediction uncertainty becomes unacceptably large.

SUMMARY OF THE INVENTION

This invention relates to a topography-aided missile guidance system that minimizes the probability that an airborne target can escape the missile's intercept envelope, where the minimization is over substantially all of the potential actions that the target may take. The system includes means for determining a plurality of feasible paths for airborne targets, means for evaluating the feasible paths and means for selecting a response based upon the probabilities of the targets following the feasible paths.

The means for determining the feasible paths comprises two stages. In the first stage, the system generates a set of paths, called feasible corridors, over a desired area. The feasible corridors define paths from a plurality of points contained within the desired area to one or more predicted destinations. The second stage of the determination occurs each time the target is detected. In the second stage, the system generates a second set of paths, called immediate paths. The immediate paths define paths within a smaller area, that area being centered on the most recently detected target position.

To determine the feasible corridors, in preferred embodiments, the system begins by predicting target intent. Target intent includes a prediction of the target's intended destinations and the general flight tactics of the target, including the target's attempt to avoid detection as much as possible. In preferred embodiments, up to five prospective destinations of the target are selected.

The feasible corridors are defined as the paths from a given point within the desired area to each of the prospective destinations, considering the topographical information relating to the area between those points. In preferred embodiments, a terrain data base is used to provide the topographical information.

In generating the feasible corridors, the system establishes a rectangular grid over the terrain data base. The grid defines path segments connecting various intersections (nodes) of the grid.

In preferred embodiments, the distance between adjacent nodes on the grid is 500 meters. However, other distances between nodes may be chosen in accordance with constraints imposed by the data base, and the desired precision and the processing speed of the system.

By connecting path segments, a path can be generated connecting any given node on the grid to the node nearest the prospective destination. However, since many different paths exist from a given node to the node nearest a given prospective destination, feasible corridors are generated by identifying which of the paths is optimal.

Identifying the optimal paths requires a comparison of the different paths. In comparing the different paths, the system considers various parameters relating to the topography adjacent to the paths. A cost, relating to the various parameters, is assigned to each path segment on the grid. A total cost for a given path can then be calculated by summing the costs of the path segments defining the path.

The costs are assigned according to an equation, or cost function. In preferred embodiments, the cost function is the weighted sum of three parameters: distance to the target, height of the terrain, and masking angle. However, in other embodiments, different cost functions may be used. The cost function generally is comprised of one or more parameters used to assign a cost to a given path segment.

A cost is associated with each path segment, in a direction defined as the direction from one given node to another. Thus, a feasible corridor is generated by identifying the path C, constructed of the path segments connecting a given node to the node nearest to a prospective destination, that minimizes $$\int_C (\alpha + \beta z(s) - \gamma m(s))\, ds,$$

where z(s) is the terrain height and m(s) is the masking angle over path segment ds.

Masking angle is the angle measured to the horizon, in the direction of the prospective destination, from each node. Thus, the masking angle would be near zero in flat, open areas; the angle would be large for a node located behind a hill; and the angle could be negative for a node positioned on top of a hill.

The parameter weights $\alpha$, $\beta$, and $\gamma$ represent the relative importance among the distance, terrain height and masking angle parameters. In preferred embodiments, the various weights are set based upon the predicted intent of the targets. Setting the weights ($\alpha$, $\beta$, $\gamma$) to (1,0,0) will give maximum weight to distance, resulting in a straight line path; a setting of (0,1,0) will give maximum weight to terrain height, resulting in a typical valley following, terrain avoidance path; and a setting of (0,0,1) will give maximum weight to masking angle, yielding a path that maximizes terrain masking over the path.

The weights reflect the relative importance among the three parameters. Therefore, as an example, a setting of (0.5,0.5,0) reflects the equal importance of distance and terrain height, and the relative insignificance of masking angle. The weights in this example will yield a path that deviates from a straight line when a substantial reduction in flight altitude can be obtained.

The feasible corridors are then generated, via the cost function, between each node on the grid and the node closest to each prospective destination. Once generated, the system stores the feasible corridors as fields, one field relating to each prospective destination. Each field consists of a cost matrix, giving the total integrated cost to the prospective destination from each node, and a direction matrix, showing the direction to take from each node along the feasible corridor. Once computed, these matrices need not be recomputed unless a change of prospective destinations or a change of the parameter weights is desired.

With the set of feasible corridors generated, the system utilizes the second stage, or immediate path generator, in determining the feasible paths. The immediate path generator is employed each time the target is detected.

Like the feasible corridor generator, the immediate path generator assigns costs to path segments between two nodes of a grid. However, the immediate path generator utilizes a second grid, centered on the node closest to the most recently detected target position.

In preferred embodiments, the second grid is a rectangle which extends approximately one-third of the distance from the most recently detected target position to the prospective destinations. The second grid, superimposed on the first grid, focuses on alternative paths to the feasible corridors within the immediate area of the most recently detected target position.

The immediate paths are defined as the minimum cost paths between the center node of the second grid (representing the most recently detected target position) and each node on the perimeter of the second grid. Like the feasible corridor generator, a designated cost function is minimized to define the minimum cost paths. The minimum cost paths are stored in a field consisting of a cost matrix, giving the total integrated cost from the center node to each node of the second grid, and a direction matrix, showing the direction to take from each node along the minimum cost path. These matrices are recomputed each time the target is detected.

In preferred embodiments, the path taken by the target, as determined by the immediate path generator, is constrained to cross the perimeter of the second grid only once. Therefore, the total cost from the most recently detected target position to a prospective destination is the cost from the most recently detected target position to a node on the perimeter of the second grid, using the immediate path cost matrix, added to the cost from the node on the perimeter of the second grid to the prospective destination, using the feasible corridor matrix. There is thus a cost associated with each node on the perimeter of the second grid.

To determine the feasible paths, the perimeter of the second grid is scanned for local minima. Each local minimum thus found defines a feasible path, consisting of the immediate path from the most recently detected target position to the node associated with the local minimum, plus the feasible corridor from that node to a prospective destination. The direction matrices for both the immediate path generator and the feasible corridor generator are used to define the paths in grid coordinates. Each path is then written to a file and used until a new target observation is made, at which time the process is repeated.

Once the feasible paths have been determined, the system evaluates the relative likelihood that each of the feasible paths will be followed. This evaluation consists of two parts. The first part assigns a probability measure to each of the prospective destinations, that measure representing the relative likelihood that each prospective destination is the target's actual destination. The second part of the analysis considers the relative costs among multiple paths to the same prospective destination, relating the costs to the probability associated with the prospective destinations.

In preferred embodiments, two factors are considered in assigning a probability measure to each of the prospective destinations: a priori analysis and distance analysis.

The a priori analysis assigns values to each of the prospective destinations, reflecting an initial estimate of the relative importance of each prospective destination. The value applied to the ith prospective destination is $W_{ap}(i)$. In preferred embodiments, the values assigned to each of the prospective destinations are normalized such that their sum is equal to one.

The distance analysis assigns values based upon the inference that the closer the target is to one of the prospective destinations, the more likely it is that the closer prospective destination is in fact the target's intended destination. In preferred embodiments, the value chosen is the reciprocal of the straight line distance, D, to the prospective destination, i, such that:

$$W_d(i)=1/D(i)$$

These values are computed each time the target is detected. As with the a priori values, the distance values for each of the prospective destinations are normalized such that their sum is equal to one.

In preferred embodiments, the a priori value, based on an initial estimate of the target's intent, would be less important in a later analysis where actual target locations and distances to the prospective destinations are available. Therefore, both the a priori and distance values are assigned weights that can be easily changed as circumstances change. The weights reflect the relative importance of the a priori and distance values in the evaluation.

The likelihood of the target's intended destination being the ith prospective destination is defined by a probability measure $$p_i=(\delta W_{ap}+\epsilon W_d)/N,\ i=1,2,\ldots,N$$

where $W_{ap}$ and $W_d$ are the a priori and distance values, respectively, and and are their respective weights. The factor N, the number of prospective destinations, normalizes the values of $P_i$ such that their sum is equal to one. Each $P_i$ represents the likelihood that the ith prospective destination is the target's intended destination.

One could easily relate the most likely prospective destination to the feasible paths to that destination and project a path for the target. However, two or more feasible paths may have been determined for each prospective destination. Therefore, the second part of the evaluation considers the relative importance of these paths.

In the second part of the evaluation, the system analyzes the relative importance of each of the feasible paths. This analysis is based upon the relative magnitudes of the integrated costs from the most recently detected target position to the prospective destination along each path. If there are k paths to the ith prospective destination, identified by k local minima along the perimeter of the second grid, the relative importance of the kth path is $$M_k(i) = P_i c_k(i) \Big/ \sum_k (c_k(i)),$$

where $P_i$ is the probability that the ith prospective destination is the target's intended destination and $c_k$ is the cost to that destination along path k. The values, $M_k(i)$, represent an assessment of the likelihood that the target will follow the designated path, k, to the prospective destination, i.

The system next selects a response based upon the probabilities of the target following the feasible paths. In preferred embodiments, the system is used to anticipate the paths of enemy helicopters. The information is then transmitted to update missiles in flight, providing course corrections for interception. However, helicopters will vary their speeds and altitudes in order to take advantage of masking by the terrain and to execute desired battle tactics. Thus, even though feasible paths have been determined beginning at the target's last detected position, the position of the target along the path after a period of time will have an uncertainty based upon the distribution of speeds that the target is likely to have.

To enhance the effectiveness of the system, the speed distribution of the target is considered. In preferred embodiments, the system contains speed distributions for a variety of possible targets, in this case enemy helicopters. The speed distributions reflect the probability density functions of average speed over an interval. In preferred embodiments, the system operator may specify the probability density function to be used.

In preferred embodiments, the feasible paths are used to guide the missile to the target. This is accomplished by the system evaluating the current position of the missile, the most recent position update of the target, and the missile intercept envelope. The missile intercept envelope is defined as the maximum remaining range before the missile runs out of fuel.

The system relates the missile's current position to a variety of potential missile locations. The potential missile locations are the locations that would result from the missile traveling for a given time increment in a plurality of candidate directions.

For a given time increment, $\Delta t$, the potential missile location in each candidate direction is determined. From each potential missile location, a Figure of Merit (FOM) for each of the feasible paths is evaluated. The FOM represents the feasibility of intercepting the target, from that potential missile location, given that the target flies along that feasible path.

In preferred embodiments, the measure of merit for the FOM evaluation is the Range Excess (RE). This is the difference between the maximum remaining range of the missile and the range to intercept. In preferred embodiments, the RE is calculated over three average target speeds determined from the probability density function. Since the speed of the missile is constant, the range to intercept will vary based on the designated path and the speed of the target. The FOM for each feasible path is the sum of the REs for each of the three average target speeds multiplied by the probability that the target will be traveling at that speed.

The overall FOM for the potential missile location is the sum of the FOMs for each of the feasible paths, weighted by the likelihood that the target will follow that path. This evaluation is made for each of the potential missile locations. The potential missile location with the maximum FOM defines the candidate direction that is then selected for the missile to travel.

The process is repeated continuously, each time considering the candidate direction for the next time interval that will maximize the probability of intercept over the largest set of flight options available to the target.

DESCRIPTION OF THE PREFERRED EMBODIMENT

Figure 1:
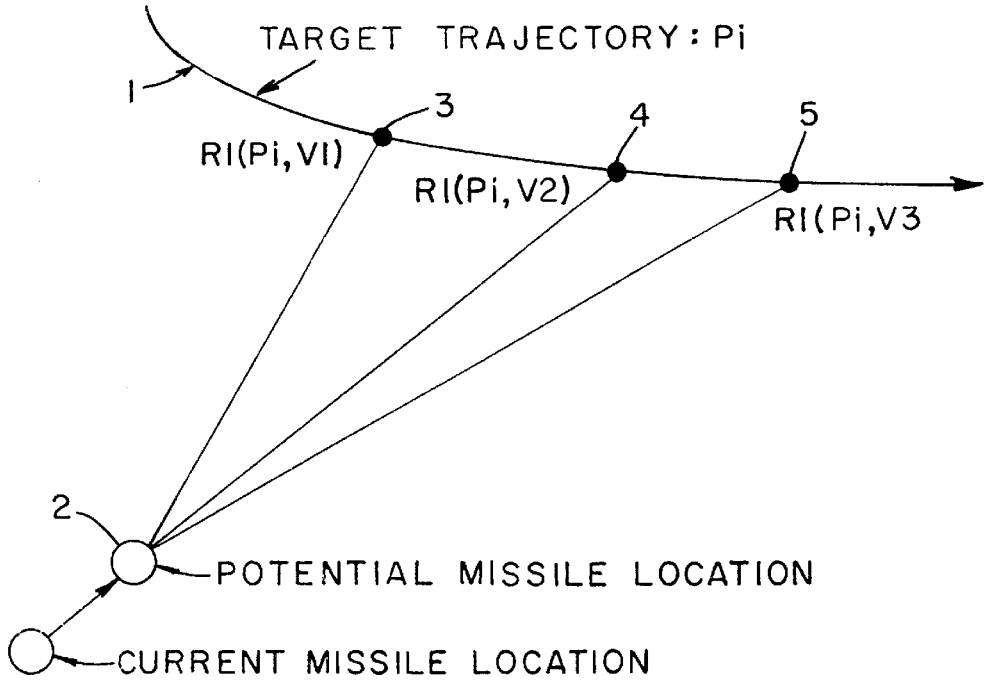
FIG. 1 illustrates the missile guidance aspect of the system.

FIG. 1 illustrates the range to intercept calculation for one target trajectory and three target velocity estimates. The target trajectory 1 represents one of the feasible paths, Pi, determined by the system. The potential missile location 2 is evaluated for each feasible path. In preferred embodiments, three velocities 3, 4, 5 for the target are selected for the evaluation of each feasible path. RI(Pi,V1) 3 represents the range to intercept from the potential missile location 2 to the target along path Pi, with the target traveling at velocity V1. Likewise, RI(Pi,V2) 4 represents the range to intercept from the potential missile location 2 to the target along path Pi, with the target traveling at velocity V2. Finally, RI(Pi,V3) 5 represents the range to intercept from the potential missile location 2 to the target along path Pi, with the target traveling at velocity V3.

Figure 2:
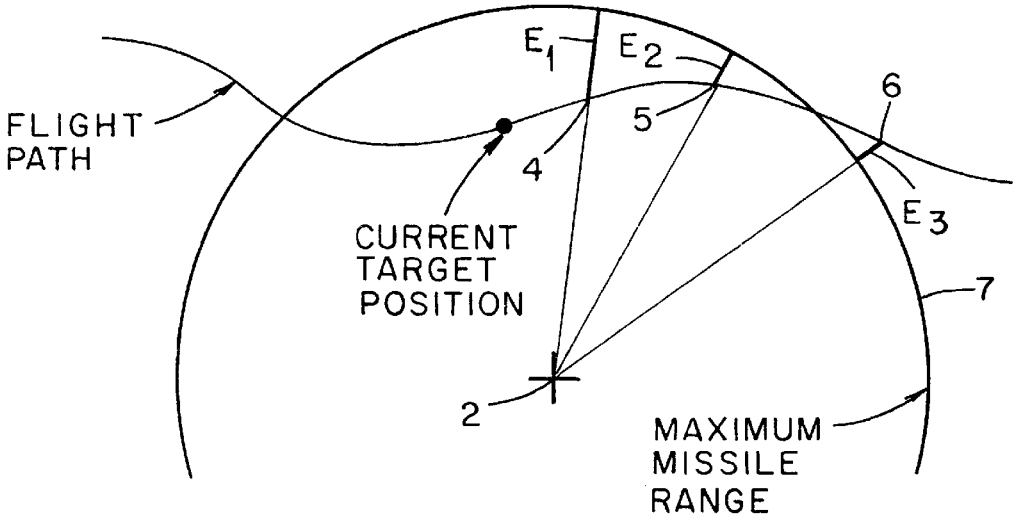
FIG. 2 illustrates the range excess calculation.

FIG. 2 shows the range excess calculation. From the potential missile location 2, the range excess is determined for each of the intercept points 4, 5, 6. The range excess for a target traveling at the low velocity is represented by value $E_1$, the middle range velocity by value $E_2$, and the highest velocity by value $E_3$. In this illustration, $E_3$ is negative indicating that the intercept point would be beyond the expected maximum range of the missile 7.

Each range excess value is multiplied by a corresponding probability that the target will be traveling at that velocity. The results are summed to arrive at the weighted range excess for that feasible path and that particular potential missile location.

While preferred embodiments of the present invention have been described and illustrated, various modifications will be apparent to those skilled in the art: and it is intended to include all such modifications and variations within the scope of the appended claims.

What is claimed is:

1. A guidance method, comprising the steps of:

determining a plurality of feasible paths, said feasible paths connecting at least one point to at least one destination, said paths being selected based upon the topography adjacent to said paths;

evaluating said feasible paths in relation to desired constraints, said constraints including constraints relating to the topography adjacent to said feasible paths; and selecting desired responses based upon said evaluation wherein selecting said desired responses comprises the steps of comparing a present location of an intercept device with at least one target, said target having a variable velocity, evaluating the probabilities of said intercept device intercepting said target for a plurality of average velocities of said target, along said plurality of feasible paths said target may follow, said evaluations to be applied in a plurality of directions of travel for said intercept device, and directing said intercept device in a desired direction based upon said evaluations.

2. The method of claim 1 in which evaluating said feasible paths comprises the steps of:

assigning costs to said plurality of paths, said costs relating to the degree by which each path fits; within said constraints; and identifying optimal paths between said points and said destinations by comparing said assigned costs of said plurality of paths to identify said optimal paths, said optimal paths comprising at least one path with desired assigned costs.

3. The method of claim 2 in which assigning the costs to a plurality of paths comprises the steps of:

projecting a grid over an area substantially encompassing said point and said plurality of destinations, said grid defining a plurality of potential path segments, said path segments being defined by two endpoints, said endpoints being defined by a pair of nodes on said grid;

calculating said costs related to said constraints for a plurality of path segments in a plurality of directions, said directions being defined by path segments connecting a first node of said pair of nodes to a second node of said pair of nodes; and storing information relating to said directions and associated costs for said plurality of path segments.

4. The method of claim 3 in which identifying said optimal paths comprises the steps of:

constructing a plurality of paths between said points and said destinations, said paths being defined by a plurality of said path segments;

determining costs for said paths, said costs being the sum of said path segment costs along said path; and comparing said costs for said paths to identify said optimal paths.

5. The method of claim 1 in which evaluating the probabilities of said intercept device intercepting said target comprises the steps of:

considering a plurality of candidate directions for which said intercept device may travel;

projecting a candidate position for said intercept device for each candidate direction, said candidate position being the projected position of said intercept device having traveled in said candidate direction for a desired time interval;

assigning values based on the likelihood of said intercept device intercepting said target for said target traveling at a plurality of average velocities along a plurality of said feasible paths; and comparing the values assigned for said plurality of candidate positions to determine said candidate position with the desired value, said candidate position defining a desired direction of travel from said plurality of directions.

6. The method of claim 5 in which assigning values comprises the steps of:

calculating a plurality of range excess values for a candidate position, said range excess values being defined as the difference between the maximum remaining range of the intercept device and the distance to intercept, said range excess values being determined for a plurality of average velocities of said target, presuming said target to travel along one of said plurality of feasible paths;

multiplying said range excess values for said path by desired weight factors relating to the probabilities of said target traveling at each of said average velocities to determine weighted range excess values;

summing said weighted range excess values for said plurality of average velocities to determine a composite range excess value for a desired feasible path for said candidate position;

calculating composite range excess values for each of said feasible paths for said candidate position;

multiplying said composite range excess values by desired weight factors relating to the probabilities of said target traveling along said feasible paths; and summing said weighted composite range excess values for said plurality of paths to determine a figure of merit to be assigned to said candidate position.

* * * * *